US006360493B1

(12) United States Patent
Torres, III

(10) Patent No.: US 6,360,493 B1
(45) Date of Patent: Mar. 26, 2002

(54) WEEP HOLE INSECT BARRIER

(75) Inventor: Ignacio Torres, III, 1810 Tarton La., San Antonio, TX (US) 78231

(73) Assignee: Ignacio Torres, III, San Antonio, TX (US)

( * ) Notice: Subject to any disclaimer, the term of this patent is extended or adjusted under 35 U.S.C. 154(b) by 0 days.

(21) Appl. No.: 09/588,987

(22) Filed: Jun. 7, 2000

(51) Int. Cl.[7] ..... E04B 1/72
(52) U.S. Cl. ..... 52/101; 52/302.7; 405/36
(58) Field of Search ..... 52/101, 302.3, 52/741.3, 741.4, 302.7; 405/36, 284

(56) References Cited

U.S. PATENT DOCUMENTS 3,429,084 A * 2/1969 Brewer ..... 52/101
4,102,093 A * 7/1978 Harris ..... 52/101
5,167,104 A * 12/1992 Alvarado ..... 52/302.1
5,203,795 A * 4/1993 Balamut et al. ..... 52/303
5,274,950 A * 1/1994 Roberts ..... 43/121
5,349,799 A * 9/1994 Schiedegger et al. ..... 52/473
5,918,427 A * 7/1999 VanderWerf ..... 52/100
6,094,857 A * 8/2000 Kennedy et al. ..... 43/132.1
6,176,048 B1 * 1/2001 Berger ..... 52/101

* cited by examiner

*Primary Examiner*—David Bagnell
*Assistant Examiner*—Tara L. Mayo
(74) *Attorney, Agent, or Firm*—Michelle L. Evans; Gunn, Lee & Keeling

(57) ABSTRACT

A weep hole insect barrier is provided for existing and new construction that prevents insects from crawling into cavity walls in a typical house through weep holes. For existing construction, the insect barrier has a flap hinged to a frame. The frame is then secured to the outside of an existing weep hole. The flap contains a screen which prevents insects from crawling in while allowing moisture to escape from the cavity walls. For new construction, the insect barrier also has a flap hinged to a frame, but the frame has two portions, a first portion containing having a flap and a second portion containing a fixed screen. In this embodiment the frame can be secured within the weep hole.

12 Claims, 4 Drawing Sheets

WEEP HOLE INSECT BARRIER

BACKGROUND OF THE INVENTION

1. Field of The Invention

Applicant's invention relates to a weep hole insect barrier for existing and new construction that prevents insects and other pests from crawling into cavity walls in a typical house through weep holes.

2. Background Information

In a typical house, a space, more particularly a cavity wall, exists between an interior wall and an exterior wall. Moisture often collects within this cavity wall so weep holes are often used to let moisture out of the cavity wall. These weep holes are simplysmall vertical openings located at the bottom of the exterior wall. Unfortunately, while the weep hole openings serve the useful purpose of letting moisture out of the cavity wall, they also act as a passageway that allows insects to crawl into the cavity wall. Once insects are in the cavity wall, they climb up to the attic and then into the interior of the home though openings such as electrical outlets, light fixtures, fans, A/C ducts, and adjacent garage spaces. This causes an insect problem for the inhabitants of the house. Applicant's invention was designed to prevent insects and other pests from crawling into cavity walls in a typical house through weep hole openings while allowing moisture to escape from the cavity walls via the weep holes, adequate ventilation, and access to the cavity wall via the weep holes.

There are several inventions known in the prior art that are related to Applicant's present invention. U.S. Pat. No. 2,530,919 issued to Taylor, provides for a wall vent which is adapted to be attached to a wall structure to permit moisture to escape from inner walls and having a screen that will prevent undesirable foreign substances from entering. U.S. Pat. No. 3,429,084 issued to Brewer, provides for a duct assembly to drain condensation from between walls and to prevent invasion of insects. U.S. Pat. No. 4,102,093 issued to Harris, provides for an insect control system for buildings of masonry construction and the like which is to be used in connection with the weep hole. U.S. Pat. No. 2,905,072 issued to Oswald, discloses a ventilator with a vermin excluding screen used in insulated frame wall structures to prevent accumulation of moisture in the walls. In U.S. Pat. No. 4,676,145 issued to Allred, a ventilating apparatus for building foundations in both brick and side type structures is disclosed which restricts the passage of objects therethrough. U.S. Pat. No. 5,167,104 issued to Alvarado, provides for a permanent weep hole cover which prevents entrance of insects.

The weep hole insect barrier of the present invention provides some advantages over the known prior art. In U.S. Pat. No. 3,429,084, numerous modifications to the weep hole are necessary before the invention is useful. This can be quite expensive and time consuming. Applicant's present invention is simpler resulting in less time and money exhausted in the project. Second U.S. Pat. No. 5,167,104 requires that the weep hole cover be permanently attached to the weep hole to prevent the insects from coming into the house. Such an invention is impractical because there may be times when access must be made to the cavity wall. Having a permanent cover in place would require the cover to be forcibly removed possibly causing damage to the housing.

The remaining prior art inventions disclosed perform the same function as Applicant's present invention, but they do so in different ways using different configurations.

SUMMARY OF THE INVENTION

It is an object of the present invention to provide a novel weep hole insect barrier that allows moisture to escape from cavity walls.

Another object of the present invention is to provide a novel weep hole insect barrier that not only allows moisture to escape from cavity walls, but provides a barrier that prevents insects and other pests from entering the cavity walls.

It is yet another object of the present invention to provide a novel weep hole insect barrier that can be used for weep holes of existing as well as new construction.

It is a further object of the present invention to provide a novel weep hole insect barrier that can have a varied frame depending on its use within existing or new construction.

Still another object of the present invention is to provide a novel weep hole insect barrier that uses a flap mechanism which allows entry by a person into the cavity wall through the weep hole if necessary while still acting as a barrier to insect invasion.

It is a further object of the present invention to provide a novel weep hole insect barrier that utilizes a screen to allow for the escape of moisture from the cavity walls.

Yet another object of the present invention is to provide a novel weep hole insect barrier that can be put in place without modification to the weep hole.

In satisfaction of these and related objectives, Applicant's present invention provides for a novel weep hole insect barrier which permits its practitioner to utilize all of the benefit of the weep hole to allow the escape of moisture from the cavity wall while preventing insects from crawling into the weep hole and infesting the house.

DETAILED DESCRIPTION OF THE PREFERRED EMBODIMENT

Figure 1:
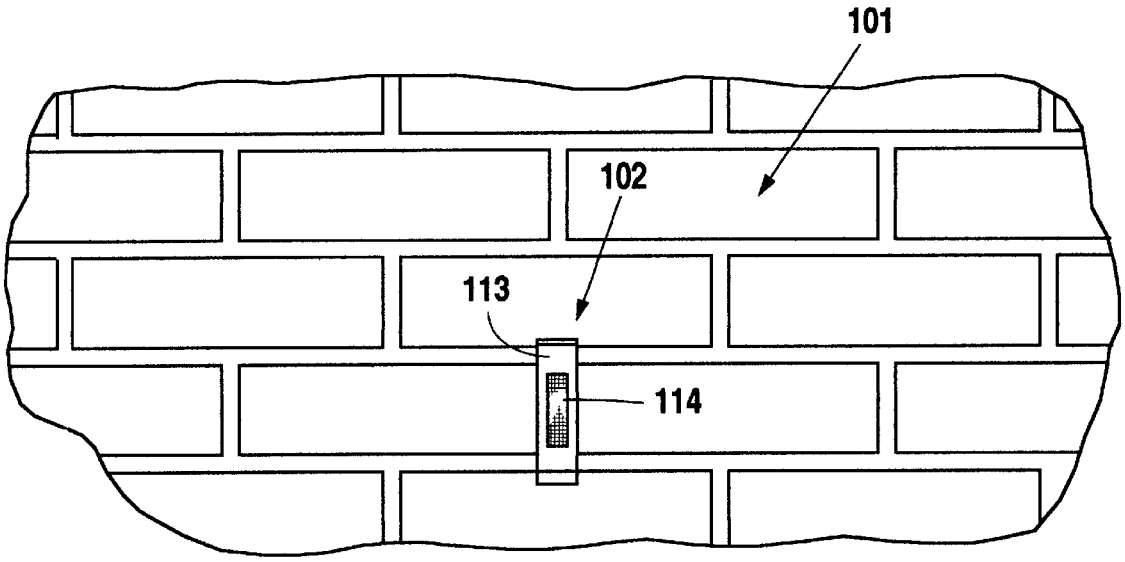
FIG. 1 is a front view of the preferred embodiment as shown on an existing brick exterior of a home.

Referring to FIG. 1, a front view of the preferred embodiment of the present invention as shown on an existing brick exterior of a home is shown. While the preferred embodiment speaks to the use on a brick exterior of a home, the preferred embodiment of the present invention can be used on any existing exterior wall that incorporates weep holes. In this view, a flap frame 113 and screen 114 of the insect barrier 102 can be seen on an existing brick exterior 101. The preferred embodiment of the present invention can be made from any suitable material such as, but not limited to, wood, metal, etc.

Figure 2:
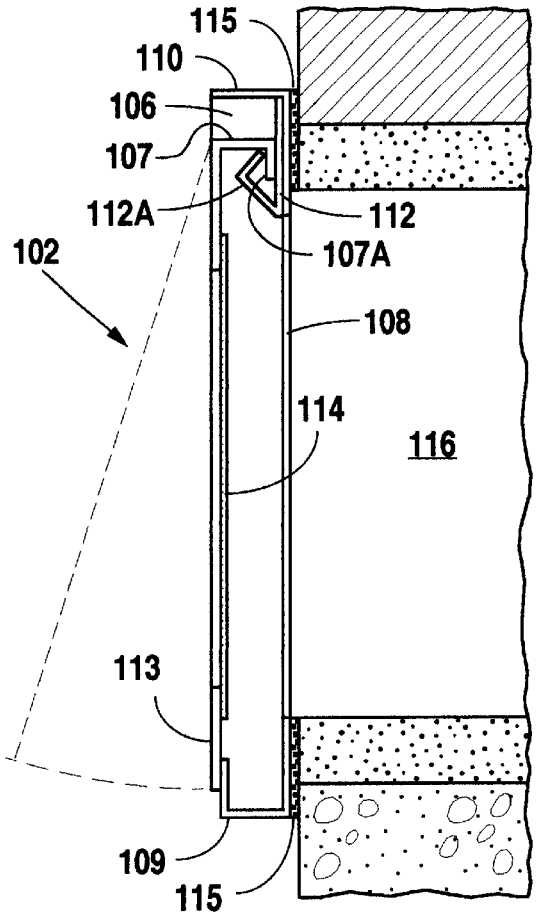
FIG. 2 is a cut away side view of the preferred embodiment of the present invention as it would exist on an existing brick exterior of a home.
Figure 3:
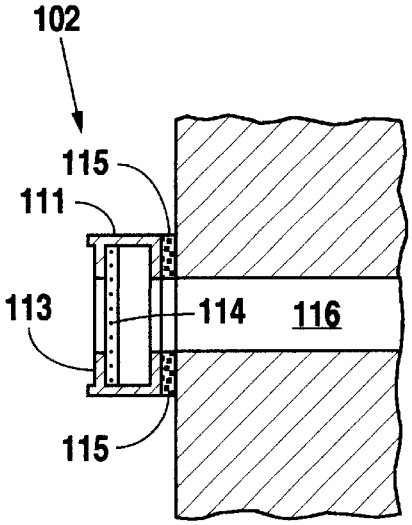
FIG. 3 is a top view of the preferred embodiment of the present invention as it would exist in an existing brick exterior of a home.

FIG. 2 and FIG. 3 illustrate a cut away side view and top view, respectively, of the preferred embodiment of the insect barrier 102 of the present invention as it would exist within an existing brick exterior of a home. A back 108 of a frame 106 of the insect barrier 102, being preferably ¾ inch in width and 3¾ inch length, is shown abutting a weep hole 116 and secured in place with adhesive 115. The insect barrier 102 has a flap 105 with the flap frame 113 and the screen 114 therein. The flap 105 is preferably ¾ inch in width by 3 inches in length. The screen 114 is preferably centrally located within the flaps 105 having dimensions of preferably ⅜ inch wide and 2⅛ inches long and having its lower edge placed preferably ½ inch from a bottom 103 of the flap 105, its upper edge placed ⅜ inch below the top 107 of the flap 105, and its sides located 3/16 inch from the frame 113. The flap frame 113 is connected at its top 107 through an L-shaped portion 107*a* to a hinge 112 by way of a hinge clip portion 112*a*. The L-shaped portion 107*a* preferably provides a lip of ⅜ inch extended over from the top 107 of the flap 105 by ⅜ inch which can be inserted into the hinge clip portion 112*a*. The hinge 112 is adhered to the back 108 of the frame 106. The back 108 of the frame 106 has a first opening 104 (See FIG. 4) which allows access through the weep hole 116 into the cavity wall (not shown).

Figure 4:
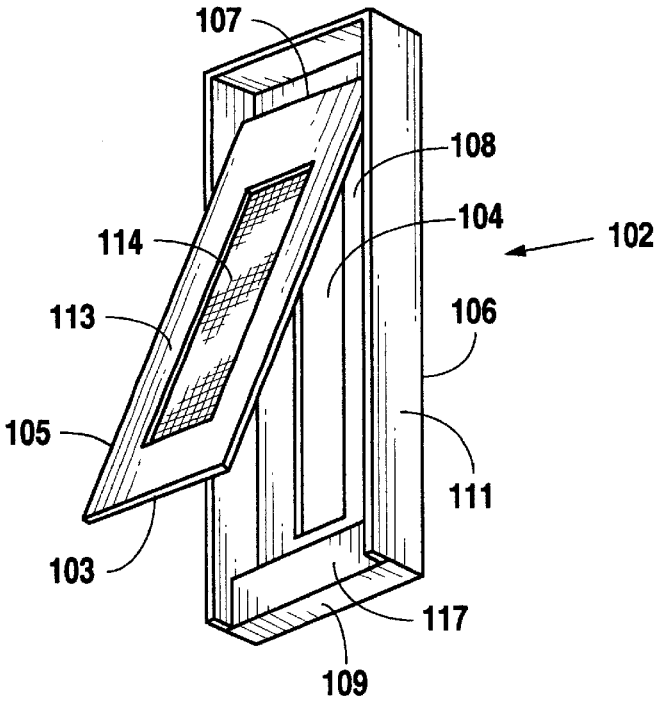
FIG. 4 is a perspective view of the preferred embodiment of the present invention as it would be used with existing exteriors.

FIG. 4 is a perspective view of the preferred embodiment of the present invention as would be used with existing exteriors. The frame 106, being preferably approximately ¾ inch wide, 3¾ inches long, and ½ inch deep, is provided which has a bottom 109, being preferably ¾ inch in width by ¼ inch in depth, a side 111, being preferably ½ inch width by 3¾ inches in length, a back 108, being preferably ¾ inch in width and 3¾ inches in length, and a first opening 104 preferably centrally located within the back 108 of the frame 106 and being preferably ⅜ inch in width, 2¼ inch in length, placed ½ inch up from a step 117, down ⅝ inch from the top 110 of the frame 106, and over 3/16 inch from the sides 111. The flap 105, having top 107, bottom 103, and frame 113, is shown in a partially lifted configuration to illustrate the hinging action of the flap 105 and the respective placement of the screen 114. The step 117, being preferably ¾ inch wide, ⅜ inch long, and ½ inch deep, is provided for upon which the flap 105 can rest when not in use.

Figure 5:
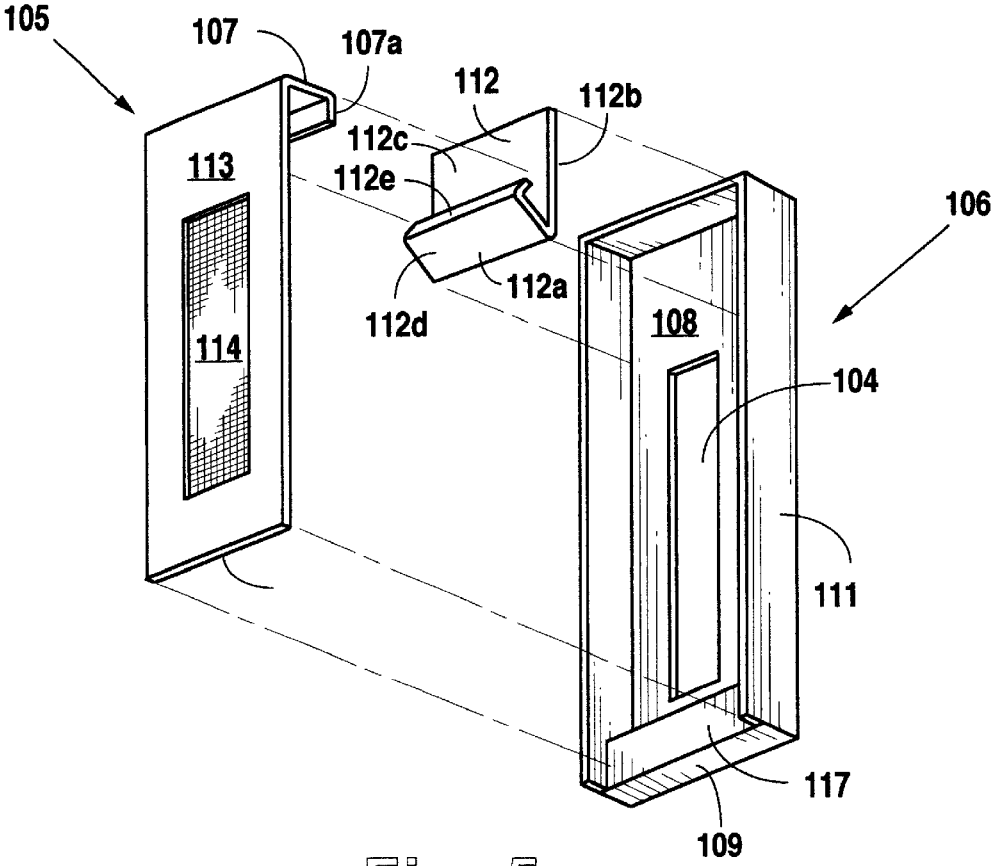
FIG. 5 is an exploded view of the preferred embodiment of the present invention as would be used with existing exteriors.

In FIG. 5, an exploded view of the preferred embodiment of the present invention is provided which would be used with existing exteriors. The frame 106 is provided having the bottom 109, side 111, back 108, and first opening 104. The flap 105, having top 107, bottom 103, and frame 113 is shown with a screen 114 therein. The L-shaped portion 107*a* of the flap 105 can be seen. This L-shaped portion 107*a* is designed to fit within the hinge 112 by way of the hinge clip portion 112*a*. The hinge clip portion 112*a* consists of three adjacent portions, a vertical portion 112*c*, a back diagonal portion 112*d*, and a front diagonal portion 112*e*. The vertical portion 112*c* being preferably ⅝ inch in length and ¾ inch in width is aligned with the back diagonal portion 112*d* at an angle of 45°. The back diagonal portion 112*d* is preferably ⅜ inch in length, ¾ inch in width and is aligned with the front diagonal portion 112*e* at an angle of 90°. The front diagonal portion 112*e* is preferably 3/16 inch long and ¾ inch wide. The backside 112*b* of the hinge 112 is designed to be adhered to the back 108 of the frame 106. The step 117 is provided for upon which the flap 105 can rest when not in use.

Once adhered to the existing weep hole 116, the insect barrier 102 can be put into use. When the flap 105 is in the closed position, the flap 105 of the insect barrier 102 keeps insects and other pests from entering into the cavity walls (not shown) via the weep holes 116 while at the same time the screen 114 acts to allow moisture out of the cavity wall (not shown) by way of the weep holes 116 as well as provide adequate ventilation. When the flap 105 is in the open position the cavity wall (not shown) can be accessed by way of the weep holes 116.

Figure 6:
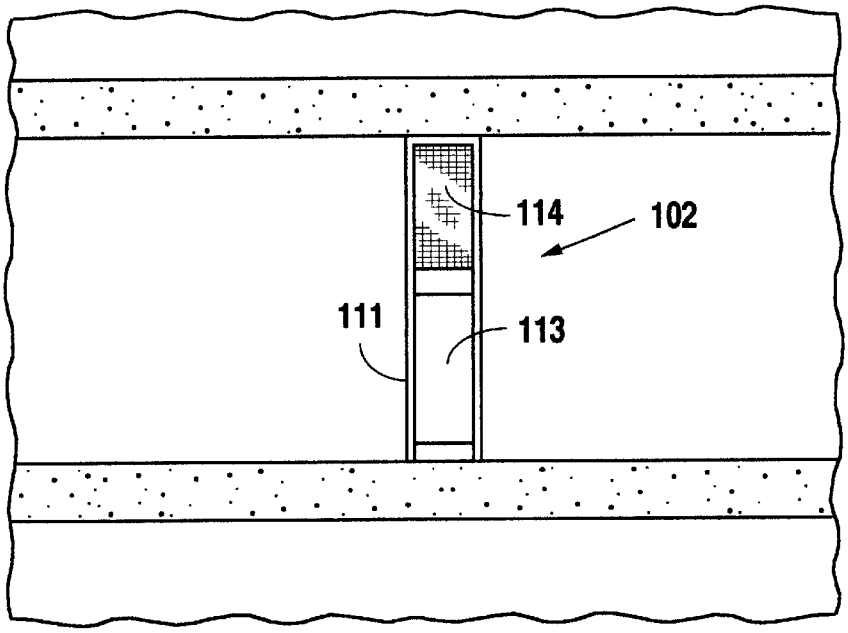
FIG. 6 is a front view of a second embodiment of the present invention as would be used for new construction.

A second embodiment of the present invention can be used in new construction rather than existing construction. FIG. 6 is a front view of the second embodiment of the present invention as shown for new construction. While the second embodiment is illustrated on a brick exterior, this embodiment can be used in any new exterior wall that incorporates weep holes. Here a flap frame 113 and screen 114 of the insect barrier 102 can be seen. The second embodiment of the present invention can be made from any suitable material such as, but not limited to, wood, metal, etc.

Figure 7:
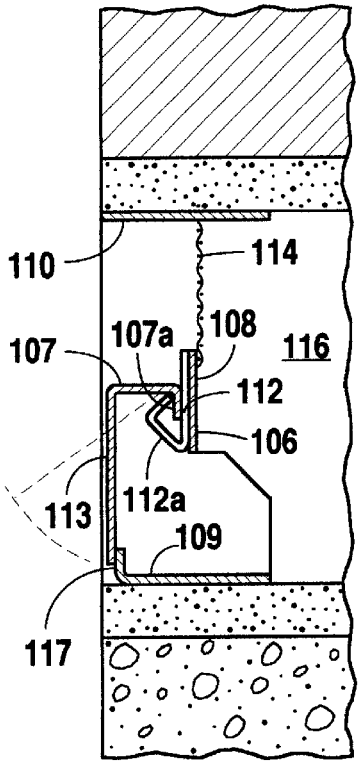
FIG. 7 is a cut away view of the second embodiment of the present invention as would be used for new construction.
Figure 8:
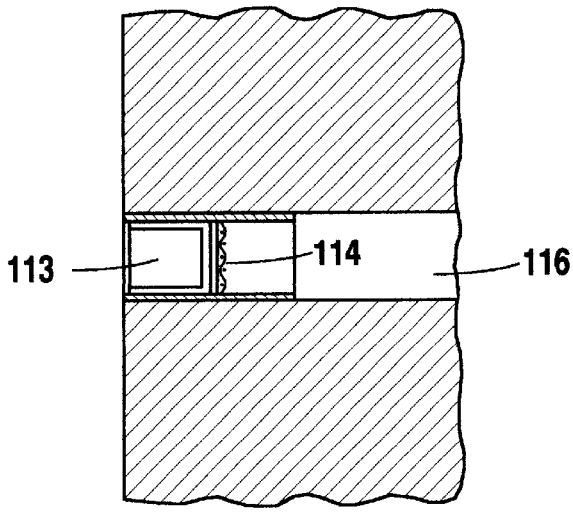
FIG. 8 is a top view of the second embodiment of the present invention as would be used for new construction.

FIG. 7 and FIG. 8 illustrate a cut away side view and top view, respectively, of the second embodiment of the present invention as it would exist for new construction. Here the second embodiment is recessed within a weep hole 116. The insect barrier has a flap 105 with a flap frame 113 which extends a partial height of the weep hole 116. The flap 105 preferably extends 1¼ inches in length from a bottom 109 of a frame 106 and is ⅜ inch in width. The flap frame 113 has an L-shaped portion 107*a* at its top 107 which fits within a hinge 112 by way of a hinge clip portion 112*a*. The L-shaped portion 107*a* is a lip of 3/16 inch which extends ½ inch from the top of the flap 105. The hinge 112 is adhered to the back 108 of the frame 106. The back 108 of the frame 106 has a first opening 104 (See FIG. 10) which allows access through the weep hole 116 into the cavity wall (not shown). Between the top 110 of the frame 106 and the top 107 of the flap frame 113 a screen 114 is extended which is fixed in position. The screen 114 is preferably ⅜ inch wide and 1 inch long.

Figure 9:
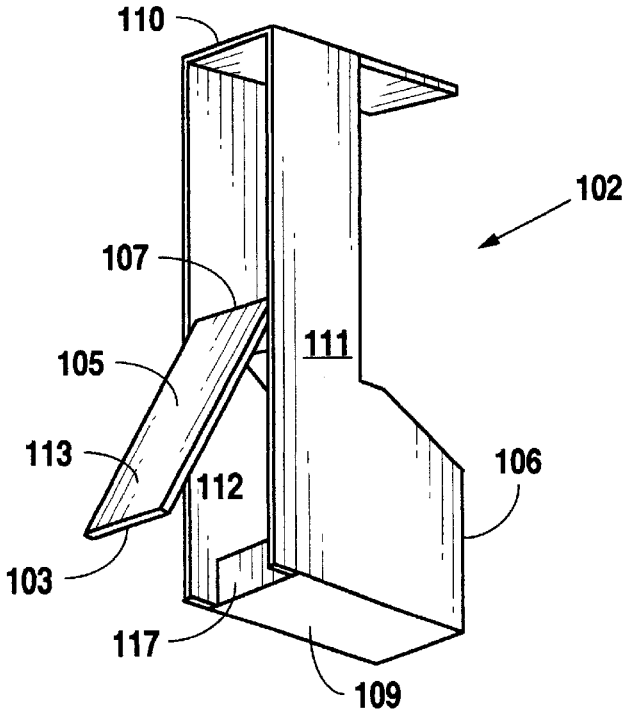
FIG. 9 is a perspective view of the second embodiment of the present invention as would be used for new construction.

In FIG. 9, a perspective view of the second embodiment of the present invention is shown as would be used with new construction. The frame 106 of the insect barrier 102, being preferably approximately 2¼ inches long, ⅜ inch wide, and 1 inch deep, is provided which has a bottom 109, being preferably ⅜ inch wide and 1 inch deep, top 110, being preferably ⅜ inch wide and 1 inch deep, and side 111. The flap 105, having top 107, bottom 103, and frame 113 is shown in a partially lifted configuration to illustrate the hinging action of the flap 105 in relation to the hinge 112. A step 117, being preferably ⅜ inch wide and 3/16 inch deep, is provided for upon which the flap 105 can rest when not in use.

Figure 10:
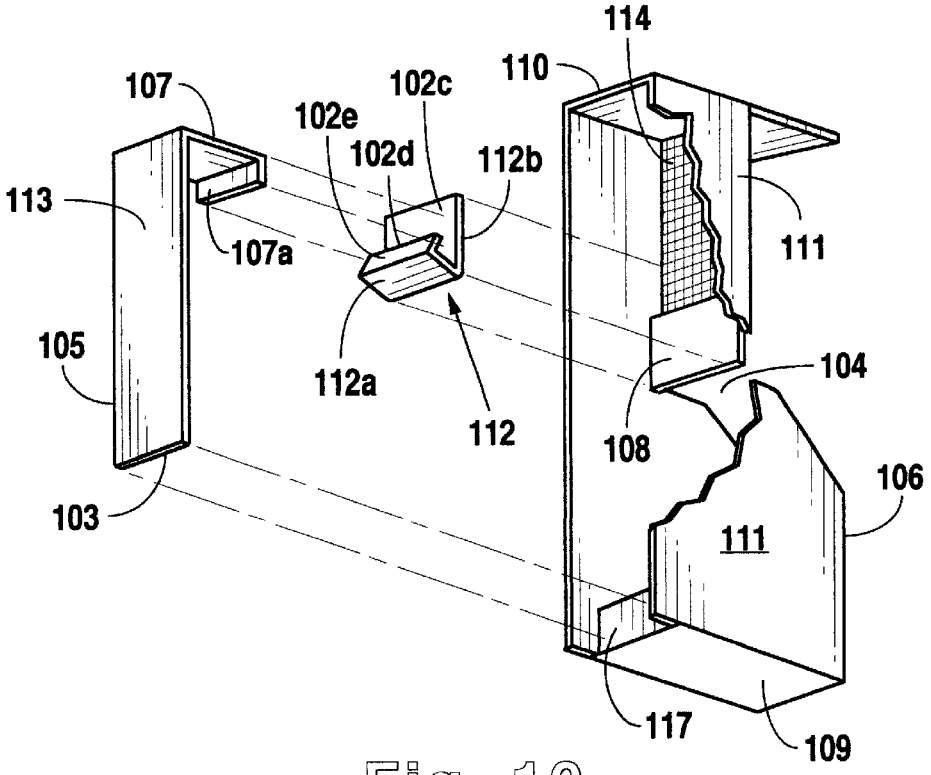
FIG. 10 is an exploded view of the second embodiment of the present invention as would be used for new construction.

FIG. 10 is an exploded view of the second embodiment of the present invention as would be used for new construction. The frame 106 is provided having the bottom 109, side 111, top 110, back 108, and first opening 104. The flap 105, having top 107, bottom 103, and frame 113 is shown. The L-shaped portion 107*a* of the top 107 of the flap 105 is designed to fit within the hinge 112 by way of the hinge clip portion 112*a*. The hinge clip portion 112*a* consists of three adjacent portions, a vertical portion 112*c*, a back diagonal portion 112*d*, and a front diagonal portion 112*e*. The vertical portion 112*c* being preferably ⅝ inch in length and ⅜ inch in width is aligned with the back diagonal portion 112*d* at an angle of 45°. The back diagonal portion 112*d* is preferably ⅜ inch in length, ⅜ inch in width and is aligned with the front diagonal portion 112*e* at an angle of 90°. The front diagonal portion 112*e* is preferably 3/16 inch long and ⅜ inch wide. The backside 112*b* of the hinge 112 is to be adhered to the back 108 of the frame 106. The step 117 is provided upon which the flap 105 can rest. The screen 114 is extended between the top 110 of the frame 106 and the top 107 of the flap 105.

Once recessed within the weep hole 116, the insect barrier 102 can be put into use. When the flap 105 is in the closed position the flap 105 of the insect barrier 102 keeps insects and other pests from entering into the cavity wall (not shown) via the weep hole 116. When the flap 105 is in the open position the cavity wall (not shown) can be accessed by way of the weep hole 116. At all times the screen 114 is in a fixed position acting to allow moisture out of the cavity wall (not shown) by way of the weep hole and providing adequate ventilation.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A weep hole insect barrier for use with existing construction on a wall having a plurality of vertical spaced apart weep holes therethrough comprising:

a frame adhered to said weep hole;

a flap attached by a hinge means to said frame; and a screen located within the dimensions of said flap, wherein when said flap is in an open position, the back of said frame allows access through said weep hole into a cavity wall and when said flap is in a closed position said flap prevents insects and other pests from entering through said weep hole into said cavity wall while said screen allows moisture to escape from said cavity wall to the atmosphere.

2. The weep hole insect barrier of claim 1 further comprising a step upon which said flap can rest when in its closed position.

3. The weep hole insect barrier of claim 2 wherein said hinge means comprises a clip having a vertical portion adjacent to a back diagonal portion which is adjacent to a front diagonal portion.

4. The weep hole insect barrier of claim 3 wherein said frame has dimensions of ¾ inch in width by 3¾ inches in length by ½ inch deep.

5. The weep hole insect barrier of claim 4 wherein said flap has dimensions of ¾ inch in width by 3 inches in length.

6. The weep hole insect barrier of claim 5 wherein said screen has dimensions of ⅜ inch in width by 2⅛ inches in length.

7. A weep hole insect barrier for use with new construction on a wall having a plurality of vertical spaced apart weep holes therethrough comprising:

a frame recessed within said weep hole;

a flap attached by a hinge means to said frame, wherein when said flap is in an open position the back of said frame allows access through said weep hole into a cavity wall and when said flap is in a closed position said flap prevents insects and other pests from crawling into said weep hole; and a screen attached to said frame for allowing moisture out of said cavity wall and providing adequate ventilation.

8. The weep hole insect barrier of claim 7 further comprising a step upon which said flap can rest when in its closed position.

9. The weep hole insect barrier of claim 8 wherein said hinge means comprises a clip having a vertical portion adjacent to a back diagonal portion which is adjacent to a front diagonal portion.

10. The weep hole insect barrier of claim 9 wherein said frame has dimensions of 2¼ inches in length by ⅜ inch in width by 1 inch deep.

11. The weep hole insect barrier of claim 10 wherein said flap has dimensions of ⅜ inch in width and 1¼ inches in length.

12. The weep hole insect barrier of claim 11 wherein said screen has dimensions of ⅜ inch in width and 1 inch in length.

* * * * *